US005709130A

United States Patent [19]

Suzuki

[11] Patent Number: 5,709,130

[45] Date of Patent: Jan. 20, 1998

[54] TRANSMISSION CLUTCH

[75] Inventor: Takayoshi Suzuki, Hamamatsu, Japan

[73] Assignee: Sanshin Kogyo Kabushiki Kaisha, Hamamatsu, Japan

[21] Appl. No.: 593,790

[22] Filed: Jan. 30, 1996

[30] Foreign Application Priority Data

Jan. 31, 1995 [JP] Japan ..... 7-013870

[51] Int. Cl.[6] ..... B63H 20/20; B63H 23/30

[52] U.S. Cl. ..... 74/378; 192/51; 192/87.15; 192/109 F; 192/110 B

[58] Field of Search ..... 74/378; 192/21, 192/109 F, 51, 52.2, 52.3, 87.15, 85 AA, 110 B, 109 A

[56] References Cited

U.S. PATENT DOCUMENTS

| | | | |
|---|---|---|---|
| 2,243,035 | 5/1941 | Hilkemeier | 192/21 X |
| 2,669,330 | 2/1954 | Banker | 192/85 AA X |
| 2,880,834 | 4/1959 | Gerst | 192/109 F X |
| 3,048,247 | 8/1962 | Cook et al. | 192/85 AA X |
| 3,212,349 | 10/1965 | Bergstedt | 74/378 |
| 3,353,641 | 11/1967 | Chana | 192/109 A X |
| 4,187,936 | 2/1980 | Davenport | 192/21 |
| 5,327,793 | 7/1994 | Hayasaka | 74/378 |

FOREIGN PATENT DOCUMENTS

| | | | |
|---|---|---|---|
| 586629 | 11/1959 | Canada | 192/85 AA |
| 2125845 | 12/1972 | Germany | 192/85 AA |

*Primary Examiner*—Rodney H. Bonck

*Attorney, Agent, or Firm*—Knobbe, Martens, Olson & Bear LLP

[57] ABSTRACT

A reversing transmission for marine propulsion units or the like. The reversing transmission includes a multiple disc clutch assembly that is cooperative with a pair of bevel gear and clutch assemblies. These bevel gear and clutch assemblies are made up of a two-part construction each comprised of a bevel gear and a tubular sleeve that is affixed to the bevel gear and which carries a series of clutch plates. A clutch actuating piston is also incorporated that has a tapered end face so as to improve and make smoother the clutch engagement.

24 Claims, 2 Drawing Sheets

TRANSMISSION CLUTCH

BACKGROUND OF THE INVENTION

This invention relates to an improved clutch for a transmission and particularly for the reversing transmission of a marine propulsion system.

A widely employed type of transmission for watercraft employs a bevel gear which is engaged on diametrically opposite sides by a pair of bevel gears. As a result of this relationship, the rotation of this pair of gears will be in opposite directions from each other. An arrangement is provided for selectively coupling one or the other of these gears to a shaft about which the gears rotate so as to effect a driving relationship between the shaft and the first bevel gear. Either shaft may constitute the input shaft in such transmission.

In order to provide smooth shifting and high power transmission capabilities, it has been the practice to employ multiple disc clutches between the counter-rotating bevel gears and the shaft upon which they are journaled. Conventionally, these counter-rotating bevel gears are provided with extended hub portions to which are splined a first series of the clutch plates. These clutch plates are engaged selectively with other clutch plates either by mechanical or hydraulic actuators.

With such an arrangement it is necessary to provide a journal arrangement for the bevel gears, their hubs, and the shaft about which they counter-rotate. The previously proposed constructions have resulted in very costly gear assemblies. This is because the sleeve onto which the clutch plates are splined is formed integrally with the gear and thus must be made from the same material and generally has the same heat treatment. This requires not only complicated machining but also the use of more expensive materials than may be required for the specific application. In addition, the placement of the supporting bearings also gives rise to problems.

It is, therefore, a principle object of this invention to provide an improved transmission clutch assembly for a transmission of this type.

It is a further object of this invention to provide an improved bevel gear and clutch arrangement that may be made at lower cost without sacrifice in either performance or quality.

One of the advantages of multiple disc clutches, as aforenoted, over the more conventional dog type clutches frequently used in this type of transmission is their ability to transmit greater power and their smoother engagement. Even though this type of clutch is more smooth in its engagement than the prior art type of devices, the engagement of even this type of clutch can be improved.

It is, therefore, a still further object of this invention to provide an improved clutch actuator for a multiple disc clutch wherein the engagement can be made smoother.

SUMMARY OF THE INVENTION

A first feature of this invention is adapted to be embodied in a reversing transmission that is comprised of a first shaft having a first bevel gear affixed for rotation therewith. A second shaft extends transversely to the first shaft and has second and third bevel gears rotatably journaled thereon. The second and third bevel gears are enmeshed with the first bevel gear on opposite sides thereof. A pair of clutch devices are provided for selectively coupling the second and third bevel gears, respectively, for rotation with the second shaft for establishing a driving connection between the first and second shafts. At least one of the clutch devices is comprised of a tubular member affixed to but not integral with the second bevel gear and at least one clutch disc fixed for rotation with the tubular member.

Another feature of the invention is adapted to be embodied for use with a multiple disc clutch comprising first and second sets of inter-related clutch plates, at least one of which sets is axially movable relative to the other for establishing a driving relationship therebetween. An actuating element is provided for actuating the clutch discs into engagement. The actuating element is provided with a slightly tapered face so as to initially contact only a portion of the clutch elements to make the engagement of the clutch elements smoother.

DETAILED DESCRIPTION OF THE PREFERRED EMBODIMENT OF THE INVENTION

Figure 1:
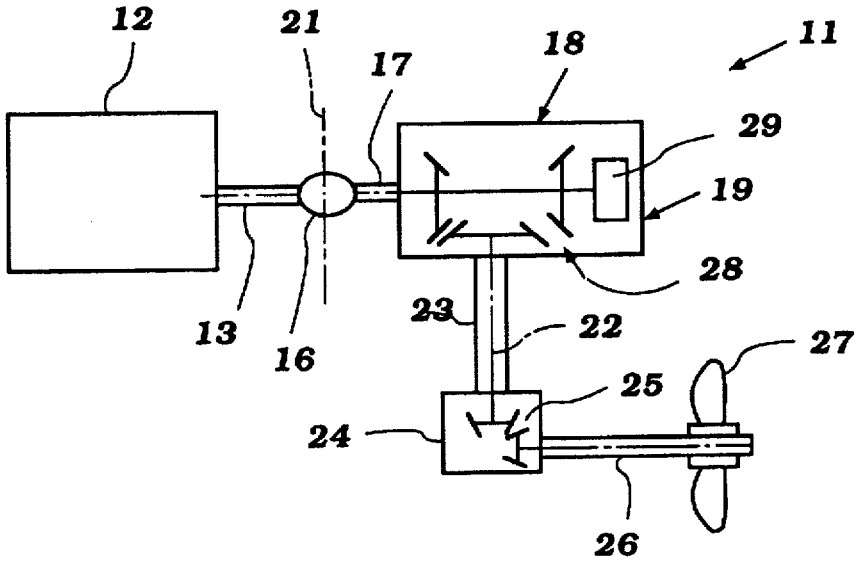
FIG. 1 is a partially schematic view showing a marine drive incorporating a reversing transmission constructed in accordance with an embodiment of the invention.

Referring now in detail to the drawings and initially to FIG. 1, a marine propulsion drive constructed in accordance with an embodiment of the invention as shown in part schematically in FIG. 1 and is identified generally by the reference numeral 11. The marine propulsion drive 11 as depicted is of the inboard/outboard type. The drive is comprised of a powering internal combustion engine 12 which is disposed forwardly of the transom of a watercraft and within its hull. The engine 12 may be of any known type and thus is illustrated only schematically.

The engine 12 has an output shaft 13 which extends rearwardly through the transom of the watercraft and is coupled by a universal joint 16 to the input shaft 17 of a reversing transmission, indicated generally by the reference numeral 18 and which forms a portion of the outboard drive portion of the inboard/outboard drive. This outboard drive portion is indicated generally by the reference numeral 19. Basically, the outboard drive portion 19 is supported and the universal joint 16 accommodates pivotal movement about a vertically extending axis, indicated by the line 21 for steering of the associated watercraft in a manner well known in this art. In addition, tilt and trim movement is accommodated about a pivotal axis that extends perpendicularly to the axis 21 and which passes through the center of the universal joint. Since these types of construction are well known in the art and form no portion of the invention, further description or illustration of them is not believed to be necessary.

The reversing transmission 18 drives in selected forward or reverse directions a drive shaft 22 that is rotatably journaled in a drive shaft housing portion 23 of the outboard drive 19. At its lower end, the drive shaft 22 depends into a lower unit 24 wherein a bevel gear transmission 25 is provided. This bevel gear transmission 25 drives a propeller shaft 26 to which a propeller 27 is affixed for providing a propulsion force for the associated watercraft.

The foregoing description is only for orientation purposes because, as has been noted, the invention deals primarily with the reversing transmission 18 and specifically the gear and clutching arrangement, indicated generally by the reference numeral 28 and which is operated by a hydraulic clutch actuator powered by a hydraulic pump 29.

Figure 2:
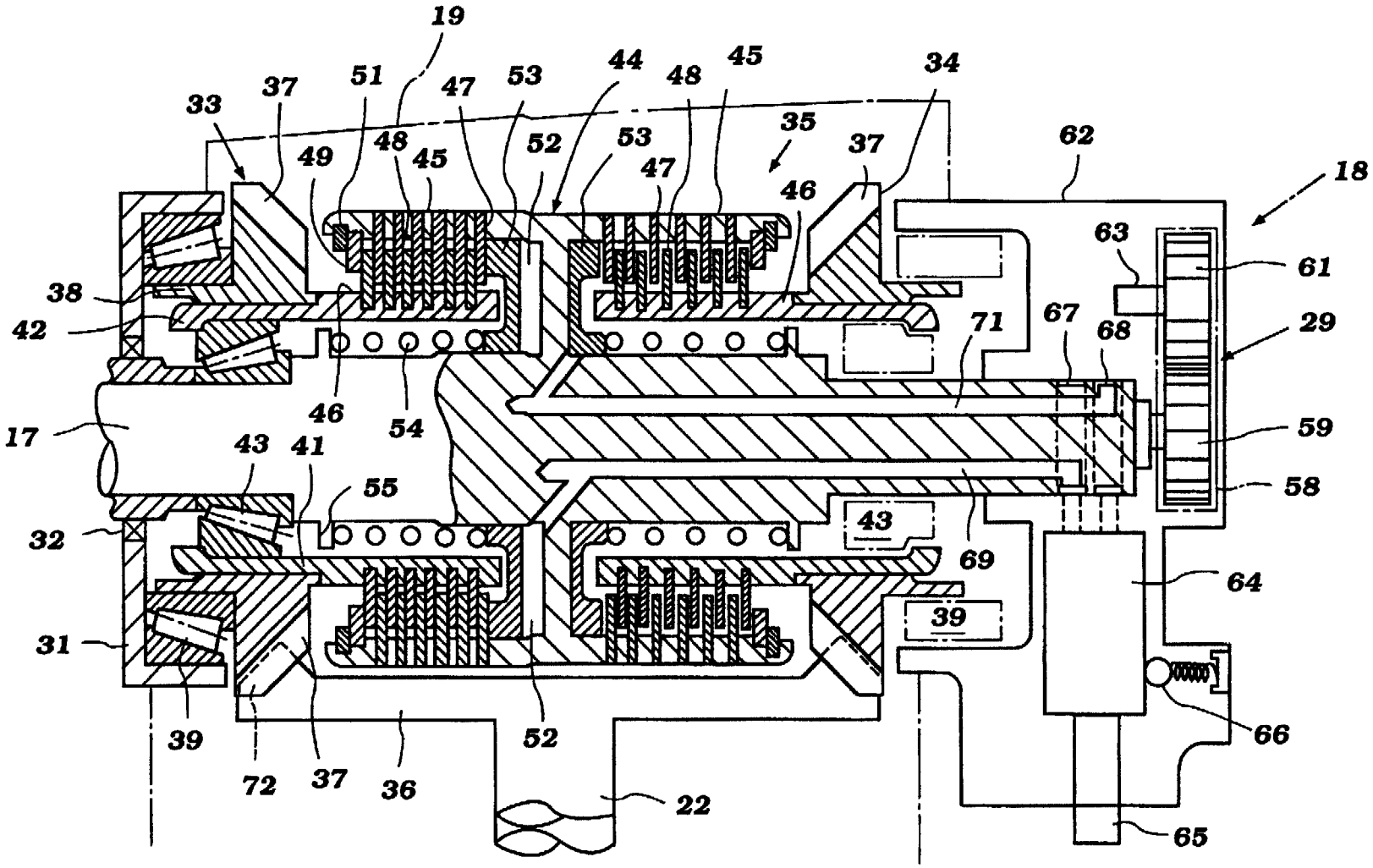
FIG. 2 is an enlarged cross-sectional view taken through the reversing transmission portion of the marine drive and shows the clutch and clutch actuating system with other components being shown in part in phantom.

The construction of the reversing transmission 18 will be described further by reference to FIG. 2 where it is shown in more detail and in a generally cross-sectional view. As may be seen, the transmission input shaft 17 extends into the housing of the outboard drive portion 19 through a front cover 31 and is surrounded by an oil seal 32. The input shaft 17 is journaled within the housing in a manner which will be described and has rotatably journaled upon it also in a manner to be described, a forward drive bevel gear and clutch assembly, indicated generally by the reference numeral 33 and a reverse drive bevel gear and clutch assembly 34. The clutch assembly portions of the bevel gear clutch assemblies 33 and 34 is indicated generally by the reference numeral 35 and is disposed primarily in the space between the bevel gears 33 and 34 and which includes in part components associated with these bevel gears.

Each of the bevel gears 33 and 34 has a construction which is substantially the same although the gears 33 and 34 are disposed in diametrically opposite reverse positions so as to mesh with diametrically opposite sides of a bevel gear 36 that is fixed to the upper end of the drive shaft 22. Because of the fact that the gear assemblies 33 and 34 are substantially the same, the components thereof which are the same but reversed are identified by the same reference numerals.

These include a bevel gear 37 that has a relatively short hub portion 38 that extends toward the respective end of the housing of the outboard drive unit 19. A first thrust bearing 39 is interposed between the hub portion 38 and the cover plate 31 at the respective end of the housing for rotatably journaling the bevel gear 37 in the housing.

Unlike prior art constructions, a separate clutch sleeve element 41 has a first portion 42 that is received within the bevel gear 39 and which extends partially through its hub portion 38. The clutch sleeve 41 may be formed from a material which is dissimilar from the material of the gear 37 itself. Thus, the high strength gear material necessary for the gears 37 need not be employed for the sleeve 41. In addition, this two-piece construction facilitates the overall machining of the clutch and gear assemblies 33 and 34. The sleeve 41 is fixed against rotation relative to the bevel gear 37 in any suitable manner which may include welding, spot welding, press-fits and the like.

At its inner end, the sleeve 41 and specifically its first portion 42 journals the input shaft 17 by means of a second thrust bearing 43. It will be noted that the thrust bearings 39 and 43 overlap each other in the axial direction. This ensures more accurate and better support for not only the input shaft 17 but also the clutch assembly 35.

Formed integrally with the input shaft 17 is an outer driving clutch sleeve, indicated generally by the reference numeral 44 and which has axially extending portions 45 that extend longitudinally along and encircle clutching element carrying portions 46 of the clutching sleeves 41. These clutching elements comprise a plurality of driving clutch plates 47 that have a splined connection to the clutching sleeve portions 45 so as to establish a rotational driving connection therebetween while permitting axial movement of the clutch plates 47 during clutch engagement and release, as will become apparent.

In a like manner, driven clutch plates 48 are provided which have a splined connection to the clutch carrying portions 46 of the sleeves 41. As is well known in this art, the clutch plates 47 and 48 are interleaved with each other. This clutch assembly made up of the plates 47 and 48 is restrained axially within the area between the sleeve portions 45 and 46 by retainer plates 49 and snap rings 51.

At the inner end of each of the clutch assemblies, there are provided piston chambers 52 in which hydraulically operated pistons 53 are slidably supported. The pistons 53 are normally urged to a retracted position by return or release springs 54 that are contained within the sleeve portions 46 and encircle the input shaft 17. These springs bear against shoulders 55 formed on the input shaft 17 at one end and against the pistons 53 at the other end.

Figure 3:
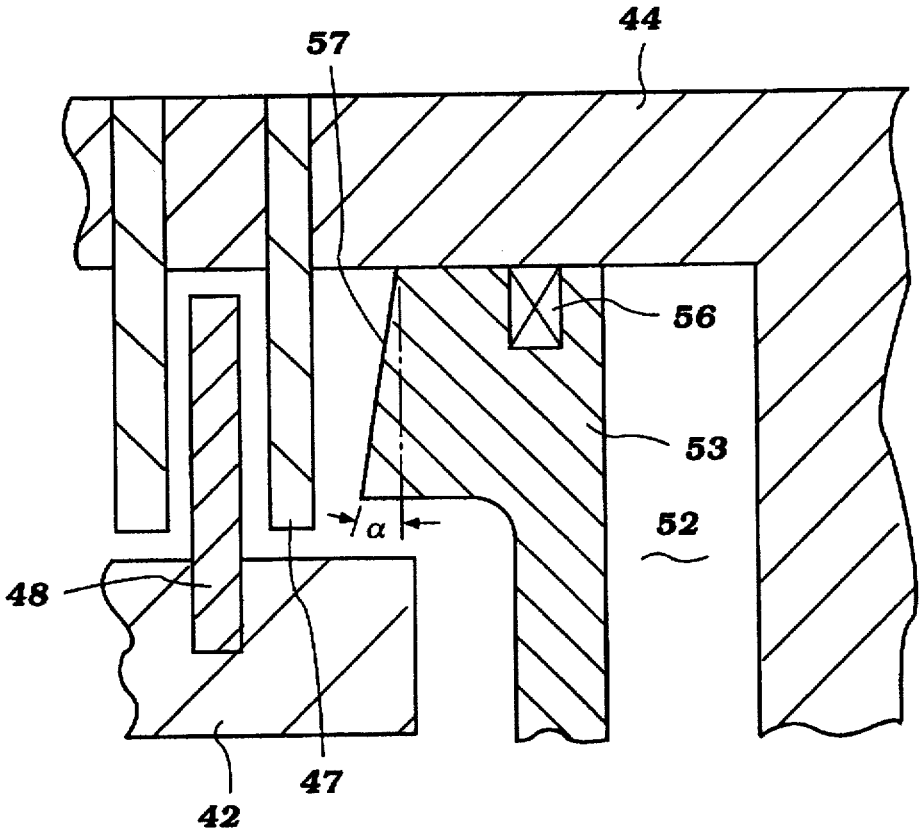
FIG. 3 is a further enlarged cross-sectional view showing the details of one of the clutch actuating pistons and the associated clutch discs.

The clutch actuating mechanism has a construction as may be best seen in FIG. 3. As will be noted, each actuating piston 53 carries a seal 56 on its outer periphery so that the clutch actuating chamber 52 is well sealed. The pistons 53 have faces 57 which are brought into engagement with the driving clutch discs 47 when the chamber 52 is pressurized sufficiently to overcome the action of the return springs 55. It should be noted that the faces 57 are disposed at a relatively narrow angle "$\alpha$" from their line of action. This angular disposition causes the engagement with the driving clutch discs 47 to occur first at their outer periphery adjacent the sleeve 41 and spaced from the splined connection to the driving clutch sleeve 44. This has been found to promote smoother engagement. The angle $\alpha$ is relatively small such as something in the range of 5°.

The manner by which the clutch pistons 53 and specifically the clutch actuating chambers 52 are pressurized will now be described by reference again to FIG. 2. As has been noted, the clutches are hydraulically actuated and pressure for this actuation is provided by a hydraulic pump assembly 29 which is driven off the rear end of the input shaft 17.

This pump assembly 29 includes a pumping chamber 58 in which a pair of intermeshing pumping gears 59 and 61 are positioned. The gear 59 is coupled to the input shaft 17 and rotates with it. The gear 61 constitutes an idler gear and is journaled in a pump housing cover plate 62 fixed to the rear end and forming a portion of the outer housing of the outboard drive 19. The gear 61 is journalled on a stub shaft 63.

The pumping action of the gears 59 and 61 draws hydraulic fluid, preferably lubricant, from a reservoir in the lower unit 24 through a suitable supply conduit. This fluid is then delivered to a selector valve, shown schematically and identified by the reference numeral 64 that is mounted beneath in the closure plate 62 beneath the input shaft 17. This selector valve 64 is operated by an actuating element 65 which is remotely controlled in a known manner.

The selector valve 64 is held in position by a ball detent 66 and selectively delivers pressure from the pump 29 to either of a pair of annular grooves 67 and 68 formed in the rear end of the input shaft 17. When one groove 67 or 68 is pressurized, the other groove 67 or 68 is open to a return conduit where fluid from the respective clutch chamber 62 may be discharged back to the aforenoted reservoir through a return passage.

The first groove 67 communicates with the forward clutch actuating chamber 52 through an axially extending passage 69 formed in the input shaft 17. The second groove 68, communicates with the reverse clutch actuating chamber 52 through a second axially extending delivery passage 71. Hence, when the passage 69 is pressurized, the passage 71 will be relieved and the clutches will move to the condition shown in FIG. 2 wherein the forward drive gear 37 is clutched for rotation with the input shaft 17. This drive is then transmitted from the teeth 37 of the forward drive gear 33 to teeth 72 of the drive shaft drive double gears 22 and thus the propeller 27 will be driven in a forward direction.

When the selector valve 64 is moved to its neutral position, both passages 69 and 71 will be relieved to the return and both clutches will be disengaged. For reverse drive, the groove 67 and passage 71 are pressurized and the groove 68 and passage 69 are relieved and the reverse clutch 34 will be engaged and the forward clutch 33 will be released.

Therefore, it should be readily apparent from the foregoing description that the described transmission is very effective in providing smooth engagement and also provides a clutch which may be more easily made and at a lower cost. Of course, the foregoing description is that of a preferred embodiment of the invention and various changes and modifications may be made without departing from the spirit and scope of the invention, as defined by the appended claims.

What is claimed is:

1. A reversing transmission comprised of a first shaft having a bevel gear affixed for rotation therewith, a second shaft extending transversely to said first shaft and having second and third bevel gears rotatably journaled thereon, said second and said third bevel gears being enmeshed with said first bevel gear on opposite sides thereof, and a pair of clutch devices for selectively coupling said second and said third bevel gears, respectively, for rotation with said second shaft for establishing a driving connection between said first and said second shafts, at least one of said clutch devices being comprised of an inner sleeve member affixed to but not integral with a hub portion one of said bevel gears and at least one clutch disc fixed for rotation with said sleeve member, and an anti-friction bearing cooperating with said inner sleeve member for rotatably journaling said inner sleeve member, said anti-friction bearing being disposed between said second shaft and said inner sleeve member for also journaling said second shaft.

2. A reversing transmission as set forth in claim 1, further including a hub portion formed integrally with the one bevel gear and a second anti-friction bearing for journaling said hub portion of said one bevel gear.

3. A reversing transmission as set forth in claim 2, wherein the second anti-friction bearing engages the outer part of the hub portion of the one bevel gear and a housing for the transmission for journaling the one bevel gear in the housing.

4. A reversing transmission as set forth in claim 3, wherein the anti-friction bearings are disposed so that they overlap each other in a direction of the axis of the second shaft.

5. A reversing transmission as set forth in claim 1, wherein both of the clutch devices are comprised of sleeve members and the respective bevel gear.

6. A reversing transmission as set forth in claim 5, wherein the clutch devices are engaged by a hydraulic actuating mechanism disposed in an axial direction between the clutch devices.

7. A reversing transmission as set forth in claim 6, further including a pair of anti-friction bearings each cooperating with a respective inner sleeve member for rotatably journaling the respective inner sleeve member.

8. A reversing transmission as set forth in claim 7, wherein both of the anti-friction bearings are disposed between the second shaft and the inner sleeve members for also journaling the second shaft.

9. A reversing transmission as set forth in claim 1, wherein each of the clutch devices is comprised of a multiple disc clutch.

10. A reversing transmission as set forth in claim 9, wherein each of the multiple disc clutches is actuated by a hydraulic piston.

11. A reversing transmission as set forth in claim 10, wherein the hydraulic piston is provided with a face tapered in a radial direction that engages the clutch plates for effecting their engagement over a progressively increasing surface area upon engagement.

12. A reversing transmission as set forth in claim 11, wherein the tapered face is configured so that the portion of the clutch plate first engaged is the portion spaced from a splined connection of the clutch plate with the member to which it is rotatably coupled.

13. A reversing transmission as set forth in claim 1, further including an outer sleeve member integrally connected with the second shaft and in facing relationship to the inner sleeve member, at least one clutch disk affixed for rotation with said outer sleeve member and adapted to be brought into frictional coupling relationship with said at least one clutch disk fixed for rotation with said inner sleeve member.

14. A reversing transmission as set forth in claim 1, further including a hub portion formed integrally with the one bevel gear and a second anti-friction bearing for journaling said hub portion of said one bevel gear.

15. A reversing transmission as set forth in claim 14, wherein the second anti-friction bearing engages the outer part of the hub portion of the one bevel gear and a housing for the transmission for journaling the one bevel gear in the housing.

16. A reversing transmission as set forth in claim 15, wherein the anti-friction bearings are disposed so that they overlap each other in a direction of the axis of the second shaft.

17. A reversing transmission comprised of a first shaft having a bevel gear affixed for rotation therewith, a second shaft extending transversely to said first shaft and having second and third bevel gears rotatably journaled thereon, said second and said third bevel gears being enmeshed with said first bevel gear on opposite sides thereof, and a pair of clutch devices for selectively coupling said second and said third bevel gears, respectively, for rotation with said second shaft for establishing a driving connection between said first and said second shafts, at least one of said clutch devices being comprised of a sleeve member affixed to but not integral with one of said bevel gears and at least one clutch disc fixed for rotation with said sleeve member, a pair of caged-type anti-friction bearings each having an inner race and interposed anti-friction members for rotatably journaling the second shaft and at least one of the second and third bevel gears relative to each other comprising an inner bearing disposed between the second shaft and the one bevel gear and an outer bearing disposed between the one bevel gear and outer housing of the transmission, at least the inner race and anti-friction members of one of said anti-friction bearings overlapping the outer race and anti-friction members of the other of said anti-friction bearings in a direction along the axis of the second shaft.

18. A reversing transmission comprised of a first shaft having a bevel gear affixed for rotation therewith, a second shaft extending transversely to said first shaft and having second and third bevel gears rotatably journaled thereon, said second and said third bevel gears being enmeshed with said first bevel gear on opposite sides thereof, and a pair of clutch devices for selectively coupling said second and said third bevel gears, respectively, for rotation with said second shaft for establishing a driving connection between said first and said second shafts, said clutch devices being comprised of an inner sleeve member affixed to but not integral with a hub portion one of said bevel gears and at least one clutch disc fixed for rotation with said sleeve member, said clutch devices being engaged by a hydraulic actuating mechanism disposed in an axial direction between said clutch devices, and a pair of pairs of anti-friction bearings, each pair rotatably journaling the second shaft and a respective one of the second and third bevel gears relative to each other, each pair comprising an inner bearing disposed between the second shaft and the respective bevel gear and an outer bearing disposed between the respective bevel gear and outer housing of the transmission, the anti-friction bearings of said pairs overlapping each other in a direction along the axis of the second shaft.

19. A reversing transmission comprised of a first shaft having a bevel gear affixed for rotation therewith, a second shaft extending transversely to said first shaft and having second and third bevel gears rotatably journaled thereon, said second and said third bevel gears being enmeshed with said first bevel gear on opposite sides thereof, and a pair of clutch devices for selectively coupling said second and said third bevel gears, respectively, for rotation with said second shaft for establishing a driving connection between said first and said second shafts, each of said clutch devices being comprised of a sleeve member affixed to but not integral with a respective one of said bevel gears and at least one clutch disc fixed for rotation with said sleeve member, said clutch devices being engaged by a respective hydraulic actuating mechanism disposed in an axial direction between the clutch devices, a pair of anti-friction bearings each cooperating with a respective of said sleeve members for rotatably journaling said sleeve member, said anti-friction bearings being disposed between said second shaft and said sleeve members for also journaling said second shaft, a hub portion formed integrally with each said bevel gears, and a pair of second anti-friction bearings each journaling a respective hub portion of said bevel gears.

20. A reversing transmission as set forth in claim 19, wherein the second anti-friction bearings engage the outer part of the hub portions of the bevel gears and a housing for the transmission for journaling the bevel gears in the housing.

21. A reversing transmission as set forth in claim 20, wherein the anti-friction bearings are disposed so that they overlap each other in a direction of the axis of the second. shaft.

22. A reversing transmission comprised of a first shaft having a bevel gear affixed for rotation therewith, a second shaft extending transversely to said first shaft and having second and third bevel gears rotatably journaled thereon, said second and said third bevel gears being enmeshed with said first bevel gear on opposite sides thereof, and a pair of clutch devices for selectively coupling said second and said third bevel gears, respectively, for rotation with said second shaft for establishing a driving connection between said first and said second shafts, at least one of said clutch devices being comprised of a sleeve member affixed to but not integral with one of said bevel gears and at least one clutch disc fixed for rotation with said sleeve member, an anti-friction bearing disposed between said sleeve member and said second shaft for rotatably journaling the sleeve member and said second shaft, a hub portion formed integrally with said one bevel gear and a second anti-friction bearing for journaling said hub portion of said one bevel gear.

23. A reversing transmission as set forth in claim 22, wherein the second anti-friction bearing engages the outer part of the hub portion of the one bevel gear and a housing for the transmission for journaling the one bevel gear in the housing.

24. A reversing transmission as set forth in claim 23, wherein the anti-friction bearings are disposed so that they overlap each other in a direction of the axis of the second shaft.

* * * * *